US006402928B1

(12) United States Patent
de Nora et al.

(10) Patent No.: US 6,402,928 B1
(45) Date of Patent: Jun. 11, 2002

(54) ALUMINIUM PRODUCTION CELL WITH AN INSULATING COVER HAVING INDIVIDUALLY REMOVABLE SECTIONS

(75) Inventors: Vittorio de Nora, Nassau (BS); Jainagesh A. Sekhar, Cincinnati, OH (US)

(73) Assignee: Moltech Invent S.A. (LU)

( * ) Notice: Subject to any disclaimer, the term of this patent is extended or adjusted under 35 U.S.C. 154(b) by 0 days.

(21) Appl. No.: 09/446,925

(22) PCT Filed: Jul. 7, 1998

(86) PCT No.: PCT/IB98/01044

§ 371 (c)(1),
(2), (4) Date: Mar. 31, 2000

(87) PCT Pub. No.: WO99/02763

PCT Pub. Date: Jan. 21, 1999

Related U.S. Application Data

(63) Continuation of application No. 08/889,290, filed as application No. PCT/IB98/01044 on Jul. 7, 1998, now abandoned.

(51) Int. Cl.[7] ..... C25C 3/08

(52) U.S. Cl. ..... 205/389; 205/390; 205/396; 204/245; 204/246; 204/247; 204/290.01; 204/293

(58) Field of Search ..... 204/245, 247, 204/246, 290.01, 293; 205/372, 390, 389, 396

(56) References Cited

U.S. PATENT DOCUMENTS

| | | | | |
|---|---|---|---|---|
| 3,110,660 A | * | 11/1963 | Miller | 204/247.5 |
| 4,222,841 A | * | 9/1980 | Miller | 204/247 |
| 4,560,449 A | * | 12/1985 | Sivilotti | 205/404 |
| 5,128,012 A | * | 7/1992 | Olsen | 204/245 |
| 5,362,366 A | * | 11/1994 | de Nora et al. | 205/375 |
| 5,368,702 A | * | 11/1994 | de Nora | 205/373 |
| 5,510,008 A | * | 4/1996 | Sekhar et al. | 205/384 |

* cited by examiner

*Primary Examiner*—Donald R. Valentine
*Assistant Examiner*—Wesley A. Nicolas
(74) *Attorney, Agent, or Firm*—Jayadeep R. Deshmukh

(57) ABSTRACT

A cell of advanced design for production aluminum by the electrolysis of an aluminum compound dissolve in a molten ectrolyte, has a cathode (30) of drained configuration, and at least one non-carbon anode (10) facing the cathode both covered by the electrolyte (54). The upper part of the cell contains a removable thermic insulating cover (60) placed just above the level of the electrolyte (54). Preferably, the cathode (30) comprises a cathode mass (32) supported by a cathode carrier (31) made of electrically conductive material which serves also for the uniform distribution of electric current feeders (42) which connect the cathode carrier (31) to the negative busbars.

28 Claims, 3 Drawing Sheets

ALUMINIUM PRODUCTION CELL WITH AN INSULATING COVER HAVING INDIVIDUALLY REMOVABLE SECTIONS

This application is a 371 of PCT/IB98/01044 filed Jul.7, 1998 which is a continuation to U.S. application Ser. No. 08/889,290 filed Jul. 8, 1997 now abandoned.

FIELD OF THE INVENTION

The invention relates to a cell for the production of aluminum by the electrolysis of an aluminum compound dissolved in a molten electrolyte, for example alumina dissolved in a molten fluoride-based electrolyte. It concerns in particular a cell of advanced design having a cathode of drained configuration, and a non-carbon anode facing the cathode both covered by the molten electrolyte.

The invention also relates to methods of operating the cells to produce aluminum.

BACKGROUND OF THE INVENTION

The technology for the production of aluminum by the electrolysis of alumina, dissolved in molten cryolite-based electrolyte and operating at temperatures around 950° C. is more than one hundred years old.

This process, conceived almost simultaneously by Hall and Heroult, has not evolved as much as other electrochemical processes, despite the tremendous growth in the total production of aluminum that in fifty years has increased almost one hundred fold. The process and the cell design have not undergone any great change or improvement and carbonaceous materials are still used as electrodes and cell linings.

The electrolytic cell trough is typically made of a steel shell provided with an insulating lining of refractory material covered by prebaked anthracite-graphite or all graphite carbon blocks at the cell floor bottom which acts as cathode and to which the negative pole of a direct current source is connected by means of steel conductor bars embedded in the carbon blocks. The side walls are also covered with prebaked anthracite-graphite carbon plates or silicon carbide plates.

Conventional aluminum production cells are constructed so that in operation a crust of solidified molten electrolyte forms around the inside of the cell sidewalls. At the top of the cell sidewalls, this crust is extended by a ledge of solidified electrolyte which projects inwards over the top of the molten electrolyte. The solid crust in fact extends over the top of the molten electrolyte between the carbon anodes. To replenish the molten electrolyte with alumina in order to compensate for depletion during electrolysis, this crust is broken periodically at selected locations by means of a crust breaker, fresh alumina being fed through the hole in the crust.

This crust/ledge of solidified electrolyte forms part of the cell's heat dissipation system in view of the need to keep the cell in continuous operation despite changes in operating conditions, as when anodes are replaced, or due to damage/wear to the sidewalls, or due to over-heating or cooling as a result of fluctuations in the operating conditions. In conventional cells, the crust is used as a means for automatically maintaining a satisfactory thermal balance, because the crust/ledge thickness self-adjusts to compensate for thermic unbalances. If the cell overheats, the crust dissolves partly thereby reducing the thermic insulation, so that more heat is dissipated leading to cooling of the cell contents. On the other hand, if the cell cools the crust thickens which increases the thermic insulation, so that less heat is dissipated, leading to heating of the cell contents.

The presence of a crust of solidified electrolyte is considered to be important to achieve satisfactory operation of commercial cells for the production of aluminum on a large scale. In fact, the heat balance is one of the major concerns of cell design and energy consumption, since only about 25% of such energy is used for the production of aluminum. Optimization of the heat balance is needed to keep the proper bath temperature and heat flow to maintain a frozen electrolyte layer (side ledge) with a proper thickness.

Considerations concerning the refractory and insulating materials used in conventional cells to control the heat flow are discussed in the monograph "Materials Used in the Hall-Heroult Cell for Aluminum Production" by H. Zhang. V. de Nora and J. A. Sekhar, published by The Minerals, Metals and Materials Society, Pennsylvania, USA, 1994, see especially Chapter 6.

In conventional cells, the major heat losses occur at the sidewalls, the current collector bars and the cathode bottom, which account for 35%, 8% and 7% of the total heat losses respectively, and considerable attention is paid to providing a correct balance of these losses.

Further losses of 33% occur via the carbon anodes, 10% via the crust and 7% via the deck on the cell sides. This high loss via the anodes is considered a inherent in providing the required thermal gradient through the anodes.

In the literature, there have been suggestions for cells operating with non-carbon anodes with or without a crust of solidified electrolyte, but so far none of these designs has proven to be feasible. Previously this was due principally to the difficulties encountered in developing anode materials that remained sufficiently stable in the aggressive environment.

However, even with available promising non-carbon anode materials such as those based on nickel-iron-aluminum or nickel-iron-aluminum-copper with an oxide surface as described in U.S. Pat. No. 5,510,008 (de Nora et al), there is still a need to provide a redesigned cell of advanced design in order to achieve the potential advantages of the oxygen-evolving anode materials on the one hand and of the drained cathode configuration on the other hand, and to improve the overall cell efficiency.

While the foregoing references indicate continued efforts to improve the operation of molten cell electrolysis operations, none suggest the invention and there have been no acceptable proposals for a cell operating with non-carbon anodes that can operate without crust formation and which also facilitate the implementation of a drained cathode configuration.

OBJECTS OF THE INVENTION

One object of the invention is to provide an aluminum production cell of advanced design incorporating non-carbon oxygen-evolving anodes which is a efficient in operation and can operate without formation of a crust of frozen electrolyte.

Another object of the invention is to provide an aluminum production cell of advanced design wherein the cell efficiency is improved by better control of the thermic losses associated with the anodically-evolved gases.

Another object of the invention is to permit more efficient cell operation by improving the distribution of electric current to the cathode cooperating with non-carbon oxygen evolving anodes.

A further object of the invention is to provide a cell of advanced design with a non-carbon anode in combination with novel cathode which has improved distribution of electric current and can be easily produced and fitted in the cell, and which simplifies dismantling of the cell to replace or refurbish the cathodes.

A yet further object of the invention is to provide a cell of advanced design which facilitates the implementation of a drained cell configuration.

Yet another object of the invention is to provide a cell of advanced design which combines the advantages of a drained cathode configuration and of non-carbon oxygen evolving anodes, is thermally efficient, easy to construct and service, and efficient in operation.

A yet further object of the invention is to provide a cell of advanced design enabling drained cathode operation where ease of removal of the anodically produced gases is combined with ease of collection of the product aluminum.

An even further object of the invention is to provide an aluminum production cell in which fluctuating electric currents that produce a variable electromagnetic field are reduced or eliminated thereby reducing or eliminating the adverse effects that lead to a reduction of the cell efficiency.

SUMMARY OF THE INVENTION

One main aspect of the invention concerns a cell of advanced design for the production of aluminum by the electrolysis of an aluminum compound dissolved in a molten electrolyte, having a cathode of drained configuration and at least one non-carbon anode facing the cathode. Both the cathode and the anode are covered by the electrolyte. In accordance with the invention, the upper part of the cell contains a removable thermic insulating cover placed just above the level of the electrolyte.

Thanks to this removable thermic insulating cover, heat losses from the anodically-evolving gases are drastically reduced, enabling the cell to operate without a frozen top crust of molten electrolyte. Moreover, removal of the anodes for servicing is simple, by removing the entire thermic insulating cover, or by removing sections of the cover associated with the individual anodes or groups of anodes.

The cathode advantageously comprises a cathode mass supported by a cathode carrier made of electrically conductive material which serves also for the uniform distribution of electric current to the cathode mass from current feeders which connect the cathode carrier to the negative busbars. The entire cathode is contained in an outer structure from which it is separated electrically and thermically. Further details of this advantageous arrangement are described in applicant's corresponding international patent application PCT/IB-97/00589.

The advanced-design cell preferably has a cell outer structure which has a top cover for additional thermic insulation and collection of the evolved gases. This top cover encloses the removable thermic insulating cover placed just above the level of the electrolyte, and both covers have passages for feeding alumina and for the exit of the evolved gases during electrolysis.

The above-mentioned cathode carrier is usually an inner metal shell or plate. In some embodiments, the inner metal shell extends substantially to the top of the cell side walls.

Usually, the active part of the non-carbon anode is covered completely by the molten electrolyte, only the anode current feeder remaining above the electrolyte. The non-carbon anode can be located above the cathode, the anode and cathode having facing horizontal surfaces, or having facing surfaces inclined to horizontal. Alternatively, the non-carbon anode has vertical or inclined active parts interleaved with corresponding vertical or inclined cathode surfaces.

In nearly all cases, the cathode will most advantageously operate as a drained cathode, though it is possible also to operate with a shallow pool of molten aluminum.

The advanced-design cell can have a removable thermic insulating cover fitting over all of the anodes, or fitting over a group of anodes. This thermic insulating cover can be removed entirely or by sections for replacement or servicing of one or more of the non-carbon oxygen-evolving anodes which are non-consumable or substantially non-consumable.

In another design, each anode is fitted with a thermic insulating cover removable with its anode. In this case, the thermic insulating covers of adjacent anodes can be arranged to fit together when the anodes are immersed in the molten electrolyte, to form a thermic insulating cover over several or all of the anodes. Also in this case, when an anode has to be removed and replaced or serviced, it can be removed with its cover, and a new or refurbished anode fitted with a cover can be inserted in place of the removed one.

As described further in the applicant's international patent application PCT/IB97/00589, the cathode of the advanced-design cell advantageously *comprises a cathode mass made mainly of an electrically conductive non-carbon material or made of a composite non-carbon material composed of an electrically conductive material and an electrically non-conductive material. This non-conductive material can be alumina, cryolite, or other refractory oxides, nitrides, carbides or combinations thereof.

The conductive material of the cathode can include at least one metal from Groups IIA, IIB, IIIA, IIIB, IVB, VB and the Lanthanide series of the Periodic Table, in particular aluminum, titanium, zinc, magnesium, niobium, yttrium and cerium, and alloys and intermetallic compounds thereof.

In any event, the bonding metal of the composite material usually has a melting point from 650° C. to 970° C. For instance, the composite material is advantageously a mass made of alumina and aluminum or an aluminum alloy, see U.S. Pat. No. 4,650,552 (de Nora et al), or a mass made of alumina, titanium diboride and aluminum or an aluminum alloy.

The composite material can also be obtained by reaction such as that utilizing, as reactants, $TiO_2$, $B_2O_3$ and Al.

The cathode mass can alternatively be made mainly of carbonaceous material, such as compacted powdered carbon, a carbon-based paste for example as described in U.S. Pat. No. 5,362,366 (Sekhar et al), prebaked carbon blocks assembled together on the shell, or graphite blocks, plates or tiles.

The cathode mass is preferably impervious to, or is made impervious to, molten aluminum and to the molten electrolyte.

To operate as a drained cathode, or with a shallow pool of molten aluminum, the cathode's active surface, usually its upper active surface, is aluminum-wettable, for example the upper surface of the cathode mass is coated with a coating of refractory aluminum wettable material such as slurry-applied titanium Lu diboride as described in U.S. Pat. No. 5,316,718 (Sekhar et al). Also, where the cathode has an inner metal cathode carrier shell or plate, its upper surface in contact with the cathode mass can be coated with a coating of refractory aluminum-wettable material or other protective materials.

Advantageously, the surface of the cathode mass is maintained at a temperature corresponding to a paste state of the electrolyte whereby the cathode mass is protected from chemical attack. For example, when the cryolite-based electrolyte is at about 950° C., the surface of the cathode mass can be cooled by about 30° C., whereby the electrolyte contacting the cathode surface forms a viscous paste which protects the cathode surface. The surface of the cathode mass can be maintained at the selected temperature by supplying gas via an air or gas space between the cathode holder and the electric and thermic insulating mass.

The anodes are preferably made principally of nickel-iron-aluminum or nickel-iron-aluminum-copper with an oxide surface. For example, the anodes are a reaction product of a powder mixture of nickel-iron-aluminum or nickel-iron-aluminum-copper, as described in U.S. Pat. No. 5,510,008 (de Nora et al). In use, the anodes can be protected by an in-situ formed or maintained protective coating of cerium oxyfluoride, as described in U.S. Pat. No. 4,614,569 (Duruz et al).

When an anode must be changed during operation, it can be removed with its associated section of the thermic insulating cover and replaced with a new anode fitted with the same section of the insulating cover or with its own thermic insulating cover.

It is advantageous to preheat each non-carbon anode before it is installed in the cell during operation, in replacement of an anode that has become disactivated or requires servicing. By preheating the anodes, disturbances in cell operation due to local cooling are avoided such as the formation of an electrolyte crust whereby part of the anode is not active until the electrolyte crust has melted.

BRIEF DESCRIPTION OF THE DRAWINGS

The invention will be further described with reference to the accompanying schematic drawings, in which.

DETAILED DESCRIPTION

Figure 1:
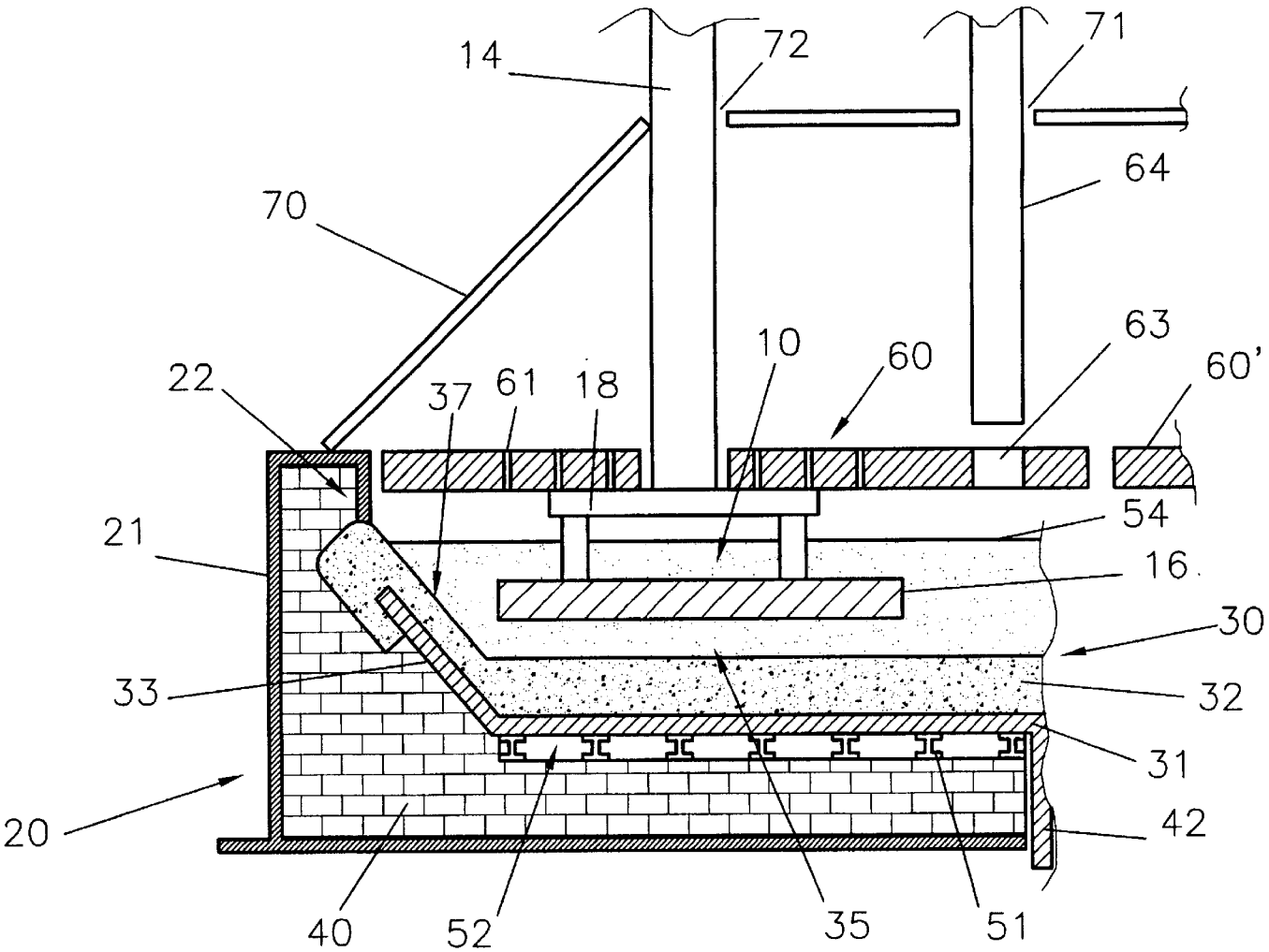
FIG. 1 is a cross-sectional view of part of an aluminum production cell of advanced design according to the invention.

The aluminum production cell according to the invention shown partly in FIG. 1 comprises a cathode pot 20 enclosed in an outer steel shell 21 lined with refractory bricks 40, and other suitable electric and thermic insulating materials, supporting a cathode 30 operating in a drained configuration. Suitable electric and thermic insulating materials are listed in the aforementioned Monograph "Materials Used in the Hall-Heroult Cell for Aluminum Production" by H. Zhang. V. de Nora and J. A. Sekhar.

Above the cathode 30 is suspended a series of a non-carbon substantially non-consumable oxygen evolving anodes 10 arranged in rows side-by-side, one such anode 10 being shown. Each anode comprises a series of 3) horizontally arranged active lower plates, rods or bars 16 suspended by a vertical current lead-in rod 14 via current distribution members 18.

In the illustrated embodiment, the cathode 20 comprises a metal cathode carrier 21 in the form of a shell or dished plate to which electric current is supplied by current distribution bars 42 leading through openings 43 in the bottom of the cell, as shown, or through its sides. As illustrated, the inner shell 31 has a flat bottom and inclined side walls 33, and forms an open-topped container for a cathode mass 32. As shown, this cathode mass 32 wraps around the edges of the cathode carrier 32's inclined side walls 33.

The cathode mass 32 is advantageously a composite alumina-aluminum-titanium diboride material, for example produced by micropyretic reaction of $TiO_2$, $B_2O_3$ and Al. Such composite materials exhibit a certain plasticity at the cell operating temperature; when supported by a rigid cathode holder plate or shell 31, these materials have the advantage that they can accommodate for thermal differences during cell start up and operation, while maintaining good conductivity required to effectively operate as cathode mass.

Alternatively the cathode mass 32 can be made of carbonaceous material, for example packed carbon powder, graphitized carbon, or stacked plates or slabs of carbon imbricated with one another and separated by layers of a material that is impermeable to the penetration of molten aluminum.

Due to the metallic conductivity of the cathode carrier shell 31, these conductor bars 41 are all maintained at practically the same electrical potential leading to uniform current distribution in the collector bars 42. Moreover, the metal inner shell 31 evenly distributes the electric current in the cathode mass 32.

Advantageously, as shown, an air or gas space 52 is provided between the underside of the cathode carrier in shell 31 and the top of the bricks 40, for example by means of horizontal girders 51. This space 52 acts as a Lu thermic insulating space. Also, it is possible to adjust the temperature of the cathode 30 (shell 31 and cathode mass 32) by supplying a heating or cooling gas to the space 52. For example, during cell start up, the cathode can be heated by passing hot gas through space 52. Or during operation, the surface of the cathode mass 32 can be cooled to make the electrolyte 54 contacting it form a protective paste.

Such cooling of the cathode 30 during operation is particularly advantageous in this advanced cell design, in combination with the overall thermic insulation of the cell which allows continuous operation with a controlled thermic balance affording maximum cell efficiency.

This space 52 can thus be used to adjust the thermal conditions inside the cell, in particular to maintain the molten electrolyte 54 at a steady temperature despite disturbances occurring in cell operation, for example when the anodes 10 are removed and replaced, so that the formation of a crust of solidified electrolyte can be avoided or minimized.

As shown, the central part of the top of the cathode 32 mass has a flat surface 35 which is inclined longitudinally along the cell and leads down into a channel or a storage for draining molten aluminum, situated at the lower end of the cell. On top of the cathode mass 32 is a coating 37 of aluminum-wettable material, preferably a slurry-applied boride coating as described in U.S. Pat. No. 5,316,718 (Sekhar et al). Such coating 37 can also be applied to the inside surfaces of the bottom and sides 33 of the cathode holder shell 31, to improve electrical connection between the inner shell 31 and the cathode mass 32.

Above each anode 10, resting on the current distribution members 18, is a thermic insulating cover 60 formed by a generally horizontal plate of suitable relatively lightweight thermic insulating material. This thermic insulating cover 60 extends sideways so that, on the outside, it fits against the inside of the top of the cell sidewall 22 leaving a gap 65, and on the inside it fits against the corresponding cover 60' of an adjacent anode also leaving a gap, 66. In the longitudinal direction of the cell too, the covers 60,60' of longitudinally adjacent anodes fit together, leaving a gap there between, if desired.

When the anode 10 is lowered to its operating position where the active part 16 of the anode is held with a small spacing above the cathode surface 35, this thermic insulating cover 60 is held level with or slightly below the top of the cell sidewalls 22 and just above the level of the electrolyte 54.

In operation, the anodically released gases can escape upwards around the edges of the thermic insulating cover 60 through the gaps 65 and through the optional additional passages 61 for exiting the anodically-released gases, as necessary.

In the center of the cell, the covers 60 have openings 63, possibly provided with closure flaps, for feeding alumina to the cell to replenish the alumina consumed during electrolysis. This can be done using point feeders 64 which can be of a known type.

The cell outer structure also comprises a top cover 70 for additional thermal insulation and for collection of the evolved gases. The top cover 70 encloses the removable thermal insulating covers 60,60', the top cover 70 also having passages 71 for feeding alumina and 72 for the anode rods 14 and for the exit of the gases evolved during electrolysis.

The described advanced design cell has an overall excellent thermic efficiency due inter alia to the novel arrangement of the removable insulating covers 60,60' placed just above the level of the molten electrolyte 54.

The thermic insulation of the cell bottom 20 and sidewalls 22 is sufficient to allow enough dissipation of heat to accomodate for the heat produced during electrolysis due to mainly to the electrical resistance of the molten electrolyte 54 in the anode-cathode gap.

Because the advanced-design cell employs non-carbon oxygen-evolving anodes 10 facing a dimensionally-stable drained cathode 30 with an aluminum-wettable operative surface 35/37, the cell can operate with a narrow anode-cathode gap, say about 3 cm or less, instead of about 4 to 5 cm for conventional cells. This smaller anode-cathode gap means a substantial reduction in the heat produced during electrolysis, leading to a need for extra insulation to prevent freezing of the electrolyte 54.

In the advanced-design cell according to the invention, the insulation in the cell bottom 20 and sidewalls 22 can be increased compared to the usual arrangements in conventional cells, to reduce heat loss by the cell structure.

More importantly, the removable thermic insulating cover (s) 60,60' placed just above the level of the molten electrolyte 54 substantially reduce heat losses via the anodes 10 and ensure proper control of thermic losses from the anodically evolved gases. The insulation of the top part of the advanced design cell is enhanced by the outer cover 70, which provides a dual insulation on top of the cell.

The optional air or gas space 52 provides a further means for control of the cell's heat balance, even if no heating/cooling gas is supplied. However, the possibility of supplying a heating/cooling gas via the space 52 provides an additional means for maintaining the cell and the electrolyte 54 at an optimum operating temperature without the formation of a crust, or with minimal crust formation.

In operation, it is advantageous to preheat each anode 10 before it is installed in the cell in a replacement of an anode 10 that has become disactivated or requires servicing. By preheating the anodes 10, disturbances in cell operation due to local cooling are avoided. In particular, this inhibits the formation of an electrolyte crust which could lead to part of an anode being disactivated until the electrolyte crust has melted.

With the described improved cell insulation, the thermic efficiency of the cell can be considerably improved, thereby improving the overall energy efficiency of the process.

Figure 2:
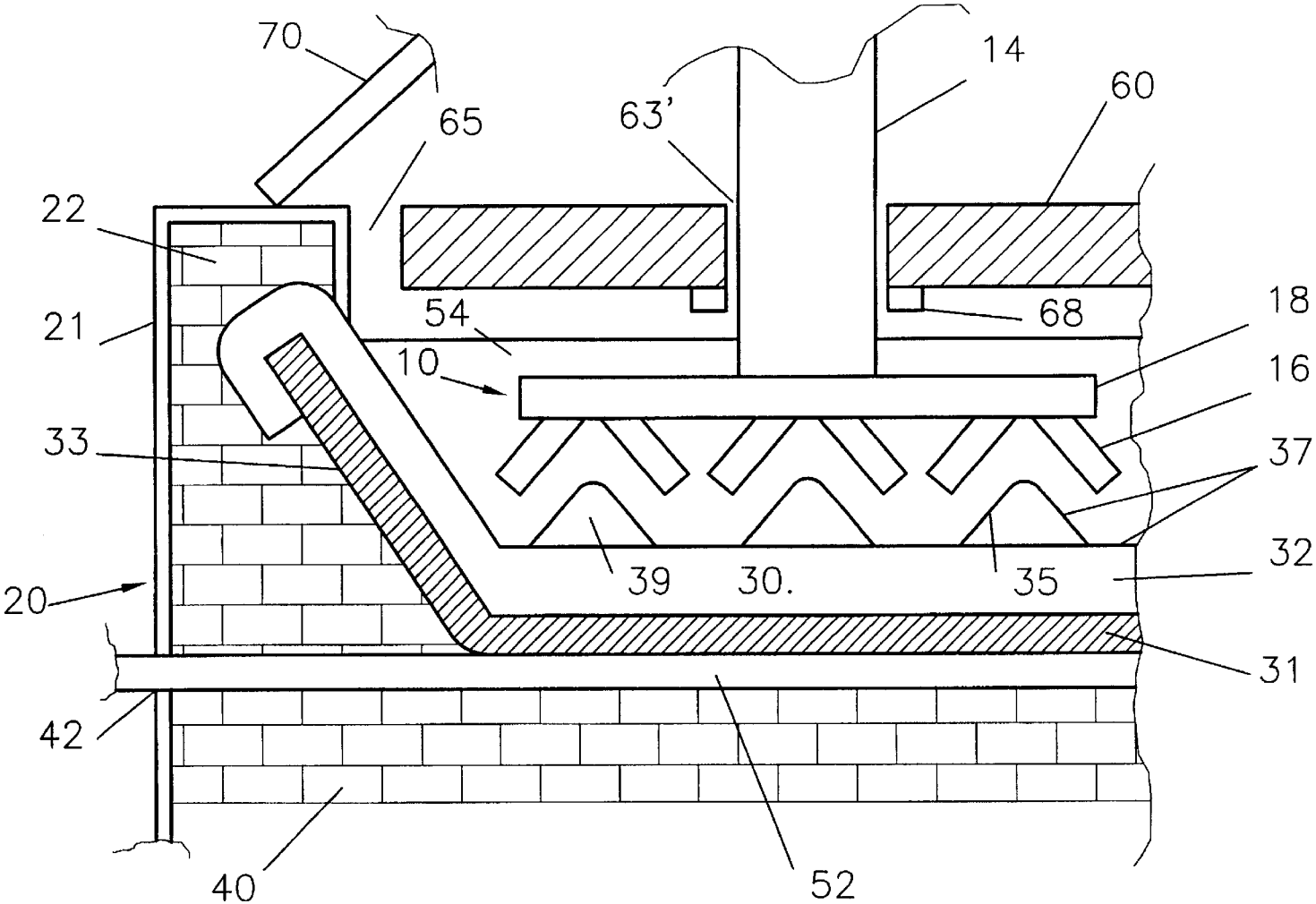
FIG. 2 is a cross-sectional view of part of another aluminum production cell of advanced design according to the invention.

FIG. 2 illustrates part of another cell according to the invention including an anode structure of modified design, the same references being used to designate the same elements as before, or their equivalents, which will not be described again in full.

In the cell of FIG. 2, above the cathode 30 is suspended a series of non-carbon substantially non-consumable oxygen evolving anodes 10, each anode 10 comprising a series of inclined active lower plates 16 suspended by a vertical current lead-in rod 14 via current distribution members 18.

In this example, the current distribution members 18 are formed by a series of side-by-side inclined metal plates 16 connected by cross-plates, not shown. The active parts of the anodes are formed by the inclined plates 16 which for example are made of nickel-iron-aluminum or nickel-iron-aluminum-copper with an oxide surface as described in U.S. Pat. No. 5,510,008 (de Nora et al). These plates 16 are arranged in facing pairs forming a roof-like configuration. The sloping inner active faces of the anodes 10 assist in removing the anodically-evolved gases, principally oxygen.

The illustrated anode 10 has three pairs of inclined plates 16 in roof-like configuration. However, the anode 10 can include any suitable number of these pairs of inclined plates.

Instead of being full, the plates 16 could be replaced by a series of rods or fingers spaced apart from one another and also inclined. In this case, the anodically-evolved gases can escape between the rods or fingers.

In the embodiment of FIG. 2, the cathode 30 also comprises a metal cathode carrier 31 in the form of a shell or dished plate to which current is supplied by current distribution bars 42 which in this case are horizontal and lead through the side of the cell. As before, the inner shell 31 has a flat bottom and inclined side walls 33, and forms an open-topped container for a cathode mass 32 which advantageously is a composite alumina-aluminum-titanium diboride material, for example produced by micropyretic reaction of $TiO_2$, $B_2O_3$ and Al and which wraps around the edges of the cathode carrier 32's inclined side walls 33.

The central part of the top of the cathode 32 mass has a flat surface which can be inclined longitudinally along the cell and leads down into a channel or a storage for draining molten aluminum, situated at one end of )the cell. On top of the cathode mass 32 is a coating 37 of aluminum-wettable material, preferably a slurry-applied boride coating as described in U.S. Pat. No. 5,316,718 (Sekhar et al). As shown in FIG, 2, on top of the cathode mass 32 are arranged a plurality of active cathode bodies 39 having inclined surfaces also coated with the aluminum-wettable coating 37 and which face the inclined faces of the active anode plates or rods 16.

Above each anode 10, resting on the current distribution members 18, is the thermic insulating cover 60. In the example of FIG. 2, the thermic insulating cover 60 is supported on the vertical anode current bar 14 by means of support flanges 68 which leave a gap 63 for gas release. As previously, the thermic insulating cover 60 extends sideways so that, on the outside, it fits against the inside of the top of the cell sidewall 22 leaving a gap 65, and on the inside it fits against the corresponding cover of an adjacent anode, as for FIG. 1. In the longitudinal direction of the cell too, the covers 60 of longitudinally adjacent anodes 10 fit together, leaving a gap there between, if desired.

With this modified anode-cathode arrangement, when the anode 10 is lowered to its operating position the inclined active plates or rods 16 of the anode 10 are held with a small spacing above the inclined cathode surface 35. In this operating position of the anodes, the thermic insulating cover 60 is held level with or slightly below the top of the cell sidewalls 22 and just above the level of the electrolyte 54.

In operation, the anodically released gases can escape upwards around the edges of the thermic insulating cover 60 through the gaps 65 and 63' for exiting the anodically-released gases.

In the center of the cell, the covers 60 have openings as described in relation to FIG. 1 for feeding alumina to the cell to replenish the alumina consumed during electrolysis using point feeders 64 which can be of a known type.

The outer structure of the cell of FIG. 2 also comprises a top cover 70 for additional thermal insulation and for collection of the evolved gases. The top cover 70 encloses the removable thermal insulating covers 60, the top cover 70 also having passages for feeding alumina and for the exit of the gases evolved during electrolysis.

The described advanced design cell of FIG. 2 also has an overall excellent thermic efficiency due inter alia to the novel arrangement of the removable insulating covers placed just above the level of the molten electrolyte 54, as described in relation to FIG. 1

This advanced-design cell employs inclined non-carbon oxygen-evolving anodes 10 facing a dimensionally-stable drained cathode 30 with inclined aluminum wettable operative surface 35/37, enabling the cell to operate with a narrow anode-cathode gap, say about 3 cm or less (particularly because of the improved gas release with the inlined anode-cathode surfaces), instead of about 4 to 5 cm for conventional cells. As discussed before, this smaller anode-cathode gap means a substantial reduction in the heat produced during electrolysis, leading to a need for extra insulation to prevent freezing of the electrolyte.

Figure 3:
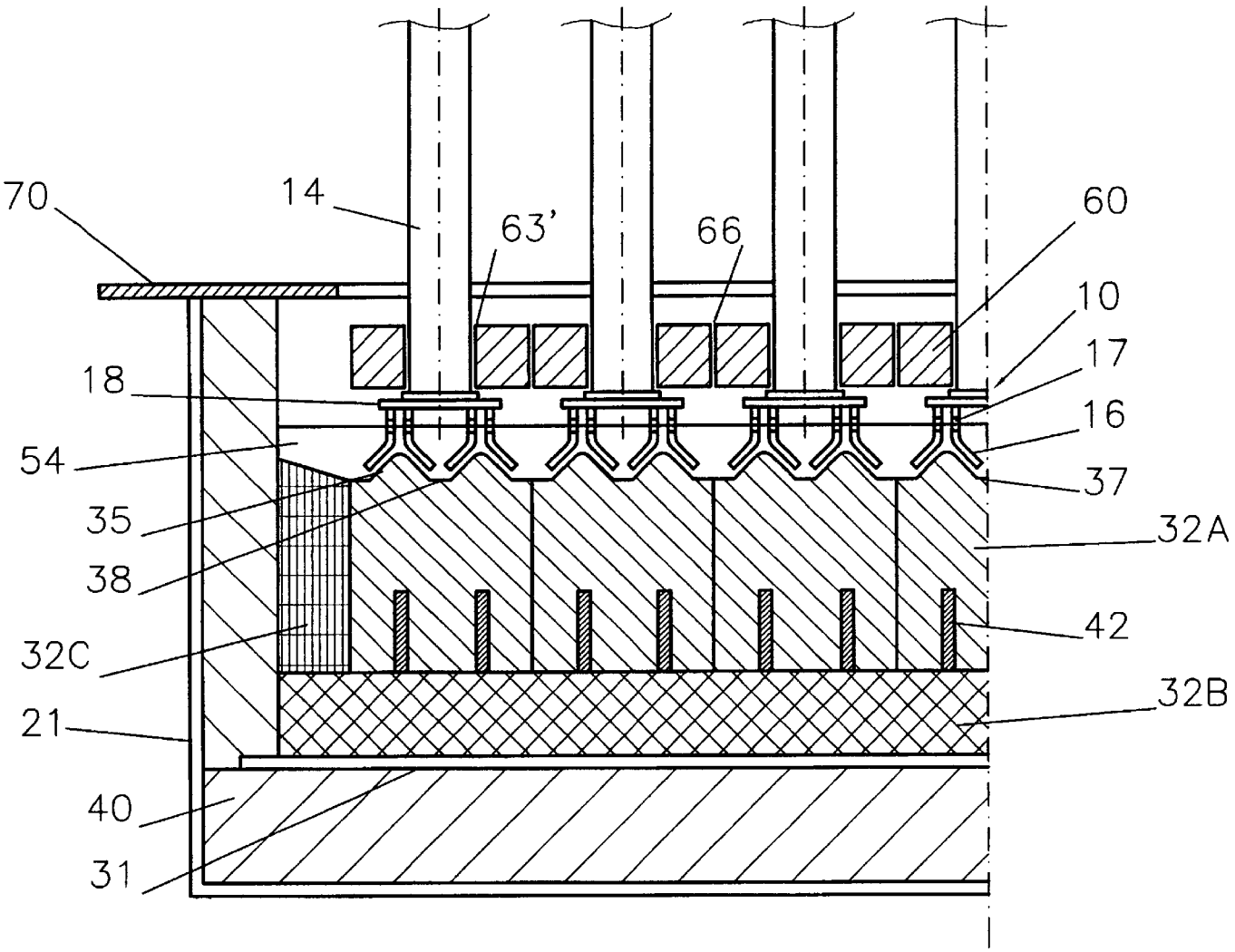
FIG. 3 is a cross-sectional view of part of yet another aluminum production cell of advanced design according to the invention.

FIG. 3 shows part of a drained-cathode aluminum production cell comprising a plurality of non-carbon oxygen-evolving anodes 10 suspended over a cathode 30 comprising a cathode mass 32A, 32B having inclined cathode surfaces 35 and coated with an aluminum-wettable coating 37, for example a slurry-applied titanium diboride coating according to U.S. Pat. No. 5,316,718 (Sekhar et al).

The lower part 32B of the cathode mass is advantageously a composite alumina-aluminum-titanium diboride material, for example produced by micropyretic reaction of $TiO_2$, $B_2O_3$ and Al. Such composite materials exhibit a certain plasticity at the cell operating temperature and have the advantage that they can accommodate for thermal differences during cell start up and operation, while maintaining good conductivity required to effectively operate as cathode mass.

The top part 32A of the cathode mass can be made of carbonaceous material, for example packed carbon powder, graphitized carbon, or stacked plates or slabs of carbon imbricated with one another and separated by is, layers of a material that is impermeable to the penetration of molten aluminum. The cathode slope can be obtained using the cross-section of the assembled cathode blocks, the sloping top surface of the assembled cathode blocks forming the active cathode surface, as further described in international patent application WO 96/07773 (de Nora).

As illustrated, each carbon block making up the top part 32A of the cathode mass has in its bottom surface two metal current conductors 42 for evenly distributing electric current in the blocks. At its edges, the top part 32A of the cathode mass is surrounded by a mass of ramming paste 32C which could alternatively be replaced by silicon carbide plates.

The lower part 32B of the cathode mass is supported on a metal cathode holder shell or plate 31 as disclosed in Applicant's international patent application PCT/IB97/00589, to which current is supplied by one or more current collector bars extending through the electric and thermic insulation 40 in the bottom of the cell, or through the sides of the cell.

As shown, the inclined active cathode surfaces 35 are arranged in a series of parallel rows of approximately triangular cross-section, extending along (or across) the cell. These surfaces 35 are inclined at an angle of for example 30° to 60° to horizontal, for instance about 45°. This slope is such that the produced aluminum drains efficiently, avoiding the production of a suspension of particles of aluminum in the electrolyte 54.

Between the adjacent inclined surfaces 35 is a trough 38 into which aluminum from the surfaces 35 can drain. Conveniently, the entire aluminum production cell is at a slope longitudinally, so the aluminum collected in the troughs 38 can drain to one end of the cell where it is collected in a storage inside or outside the cell.

The anodes 10 are suspended above the cathode 30 40 with a series of active inclined anode surfaces on inclined plates 16 facing corresponding inclined cathode surfaces 35 leaving a narrow anode-cathode space, which can be less than 3 cm, for example about 2 cm. The active parts of the anodes formed by plates 16 are for example made of nickel-iron-aluminum or nickel-iron-aluminum-copper with an oxide surface as described in U.S. Pat. No. 5,510,008 (de Nora et al). As shown in FIG. 3, these plates 16 are arranged in facing pairs forming a roof-like configuration.

The sloping inner active faces of the anode plates 16 assist in removing the anodically-evolved gases, principally oxygen. The chosen slope—which is the same as that of the cathode surfaces 35, for example about 45° —is such that the bubbles of anodically-released gas are efficiently removed from the active anode surface before the bubbles become too big. The risk of these gas bubbles interacting with any particles of aluminum in the electrolyte 54 is thus reduced or eliminated.

Each anode 10 comprises an assembly of metal members that provides an even distribution of electric current to the active anode plates 16. For this, the active anode plates 16 are suspended from transverse conductive plates 18 fixed under a central longitudinal plate 19 by which the anode is suspended from a vertical current lead-in and suspension rod 14, for example of round or square cross-section.

For example, each anode 10 is made up of four pairs of active anode plates 16 held spaced apart and parallel to one another and symmetrically disposed around the current lead-in rod 14. Each active anode plate 16 is bent more-or-less about its center at about 45°, the opposite plates 16 of each pair being spaced apart from one another with their bent lower ends projecting outwardly, so they fit over the corresponding inclined cathode surfaces 35. In their upper parts, the anode plates 16 have openings 17 through which anodically-generated gas can pass and which serve for the circulation of electrolyte 54 induced by the released gas.

Above the active parts of the anodes 10 is supported a horizontal removable insulating cover 60 which rests above the level of the electrolyte 54. This cover 60 is made in sections which are removable individually with the respective anodes 10, leaving gaps 66 for gas release. Gas-release gaps 63' are also optionally arranged around the anode rods 14.

On top of the cell is an outer horizontal cover 70 that has a central opening to allow the passage of the anodes 10 and sections of the cover 60 when the anodes need to be serviced. Spaces are also provided for feeding alumina between the anodes 10.

In operation of the cell of FIGS. 2 and 3, it is also advantageous, as discussed for FIG. 1, to preheat each anode 10 before it is installed in the cell in replacement of an anode 10 that has become disactivated or requires servicing.

It is also possible to provide an air or gas space, like space 52 on FIG. 1, in the embodiments of FIGS. 2 and 3.

What is claimed is:

1. A cell for the production of aluminum by the electrolysis of an aluminiun compound dissolved in a molten electrolyte, comprising a plurality of individual non-carbon anodes or a plurality of groups of non-carbon anodes facing at least one cathode covered by the electrolyte, and a thermic insulating cover placed above the level of the electrolyte to reduce heat loss, wherein the insulating cover comprises a plurality of removable sections, each removable section being associated with au individual anode or a group of anodes, each removable section associated with each individual anode or group of anodes extending sideways so as to fit a corresponding removable section associated with an adjacent individual anode or group of anodes, where the insulating cover is removable by sections so that the individual anodes or groups of anodes separately replaceable or serviceable by removing only the removable sections associated therewith from the insulating cover.

2. The cell of claim 1, wherein each cover section is removable with the individual anode or the group of anodes associated with therewith.

3. The cell of claim 1, wherein the cathode comprises a cathode mass supported by a cathode carrier made of electrically conductive material which serves also for the uniform distribution of electric current to the cathode mass from current feeders which connect the cathode carrier to the negative busbars, the entire cathode being contained in an outer structure from which it is separated electrically and thermically.

4. The cell of claim 1, which comprises a cell outer structure which has a top cover for additional thermic insulation and collection of the evolved gases, the top cover enclosing the removable thermic insulating cover placed just above the level of the electrolyte, both covers having passages for feeding alumina and for the exit of the evolved gases during electrolysis.

5. The cell of claim 4, wherein the cathode carrier is an inner metal shell or plate.

6. The cell of claim 5, wherein the cathode carrier is an inner metal shell which extends substantially to the top of the cell side walls.

7. The cell of claim 1, wherein the active part of the non-carbon anode is covered completely by the molten electrolyte.

8. The cell of claim 1, wherein the non-carbon anode is above the cathode.

9. The cell of claim 1, wherein the non-carbon anode has vertical or inclined active parts interleaved with corresponding vertical or inclined cathode surfaces.

10. The cell of claim 1, comprising a removable thermic insulating cover fitting over a plurality of anodes.

11. The cell of claim 2, wherein each anode is fitted with a thermic insulating cover removable with the anode.

12. The cell of claim 1, wherein the cathode comprises a cathode mass made mainly of an electrically conductive non-carbon material.

13. The cell of claim 12, wherein the cathode mass is made of a composite material made of an electrically conductive material and an electrically non-conductive material.

14. The cell of claim 13, wherein the non-conductive material is alumina, cryolite, or other refractory oxides, nitrides, carbides or combinations thereof.

15. The cell of claim 13, wherein the conductive material is at least one metal from Groups IIA, IIB, IIIA, IIIB, IVB, VB and the Lanthanide series of the Periodic Table and alloys and intermetallic compounds thereof.

16. The cell of claim 15, wherein the conductive material is at least one metal from aluminum, titanium, zinc, magnesium, niobium, yttrium and cerium.

17. The cell of claim 15, wherein the metal has a melting point from 650° C. to 970° C.

18. The cell of claim 13, wherein the composite material is a mass comprising alumina bonded with aluminum or an aluminum alloy.

19. The cell of claim 18, wherein the composite material is a mass made of alumina and titanium diboride bonded with aluminum.

20. The cell of claim 1, wherein the cathode mass is impervious to molten aluminum and to the molten electrolyte.

21. The cell of claim 1, wherein the upper surface of the cathode mass is coated with a coating of Ad refractory -aluminum-wettable material.

22. The cell of claim 1, wherein the anodes are made of nickel-iron-aluminum or nickel-iron-aluminum-copper with an oxide surface.

23. The cell of claim 22, wherein the anodes are a reaction product of a powder mixture of nickel-iron-aluminum or nickel-iron-aluminum-copper.

24. A method of producing aluminum using a cell for the production of aluminum by the electrolysis of an alumniniurm compound dissolved in a molten electrolyte, comprising a plurality of individual non-carbon anodes or a plurality of groups of non-carbon anodes facing at least one cathode covered by the electrolyte, and a thermic insulating cover placed above the level of the electrolyte to reduce heat loss, wherein the insulating cover comprises a plurality of removable sections, each removable section being associated with an individual anode or a group of anodes, each removable section associated with each individual anode or group of anodes extending sideways so as to fit a corresponding removable section associated with an adjacent individual anode or group of anodes, wherein the insulating cover is removable by sections so that the individual anodes or groups of anodes are separately replaceable or serviceable by removing only the removable sections associated therewith from the insulating cover, said method comprising maintaining the surface of the cathode at a temperature conesponding to a paste state of the electrolyte whereby the cathode is protected from chemical attack.

25. The method of producing aluminum of claim 24, wherein the surface of the cathode is maintained at the selected temperature by supplying gas via an air or gas space between the cathode and an electric and thermic insulating mass forming a cell lining.

26. The method of starting up the cell of claim 24, wherein the cathode is heated by supplying beating gas via an air or gas space between the cathode and an elctc and thermic insulating mass.

27. The method of operating the cell of claim 24, wherein anodes are changed during operation by removing an anode with its associated thermic insulating cover and a replacing a new anode with the same thermic insulating cover or with its own thermic insulating cover.

28. The method of operating the cell of claim 24, wherein before an anode is installed in the cell during operation, the anode is pre-heated.

* * * * *